United States Patent [19]

Guard

[11] 4,102,513

[45] Jul. 25, 1978

[54] FILM WRAPPING DISPENSER

[76] Inventor: Twyman Guard, 795 S. Alton Way, Denver, Colo. 80231

[21] Appl. No.: 833,138

[22] Filed: Sep. 14, 1977

[51] Int. Cl.[2] ..... B65H 23/06; B44C 7/00

[52] U.S. Cl. ..... 242/75.4; 156/577

[58] Field of Search ..... 242/75.4, 68.4, 99, 242/68, 67.1 R, 67.3 R, 54, 55, 156.2; 100/9; 53/139.3; 156/577

[56] References Cited

U.S. PATENT DOCUMENTS

| | | | |
|---|---|---|---|
| 923,559 | 6/1909 | Moser | 242/99 |
| 1,610,736 | 12/1926 | Blevins | 242/99 |
| 1,884,183 | 10/1932 | Pearson | 242/156.2 |
| 2,549,136 | 4/1951 | Simpson | 53/139.3 |
| 2,563,542 | 8/1951 | Mackelduff | 53/139.3 |
| 2,591,136 | 4/1952 | Cleary | 53/139.3 |
| 3,369,952 | 2/1968 | Rieger | 156/577 |

*Primary Examiner*—Edward J. McCarthy
*Attorney, Agent, or Firm*—Ancel W. Lewis, Jr.

[57] ABSTRACT

A dispenser for wrapping a roll of plastic stretch film under tension about an object has a reel assembly provided with an adjustable drag arrangement to set and adjust the tension on the film during the wrapping operation by the manipulation of a hand grip. Two hand grips are connected to and arranged relative to the reel assembly for the balanced support thereof during wrapping. One hand grip is operatively associated with one of a pair of rotary end supports for the roll of film in such a way that movement of the one hand grip changes the drag on the roll and thereby the tension on the film during the wrapping thereof.

21 Claims, 5 Drawing Figures

FILM WRAPPING DISPENSER

FIELD OF THE INVENTION

This invention generally relates to dispensers for rolled material and more particularly to a novel and improved hand-held dispenser particularly suited for wrapping plastic stretch film under tension about an object.

BACKGROUND OF THE INVENTION

A recent development in the shipping trade is the use of a plastic stretch film or stretch wrap to secure a plurality of containers on a pallet. Among the advantages of the use of a stretch wrap film are the tight holding qualities, no adhesives, clarity of identification of the contents, puncture resistance, and relatively low cost. In the past fairly complex wrap apparatus has rotated the pallet relative to a reel assembly that is supported by a stationary support. Some attempts have been made to use hand-held dispensers but these have not been entirely satisfactory from the standpoint of a uniformity of wrap, tension adjustment, simplicity, durability, balance, or ease of manipulation for various types of objects.

Of particular importance in effectively applying the stretch film to containers on a pallet is the ability to readily preset, to change, and to quick-release the tension on the film. Maximum stretch is required when wrapping around corners and less stretch along straight surfaces between corners. The location of the hand grips relative to the roll affects the balance and the ability to uniformly apply the film under a selected tension. The ease of replacing the roll of film is also a significant factor to be considered.

Accordingly, it is an object of the present invention to provide a simple, durable, and easy to use dispenser for stretch wrap film operations and the like.

Another object of the present invention is to provide a novel stretch wrap film dispenser characterized by a good balance and the application of the film under substantially uniform tension across the full width of the film for a uniform wrap.

Still another object of the present invention is to provide a film dispenser in which the roll is readily replaced.

A further object of the present invention is to provide a novel hand-held plastic film dispenser characterized by the use of one hand grip that is readily movable during the wrapping of the film about an object to adjust the drag on the roll and thereby the tension on the film.

SUMMARY OF THE INVENTION

A hand-held dispenser for the controlled wrapping of plastic stretch film subject to tension about an object includes a reel assembly for supporting the roll of film for rotation to unwind the film having an adjustable drag operated by the movement of one hand grip to preset the tension on the film and adjust the tension on the film as it is being pulled from the reel assembly and wrapped about an object. The reel assembly has a pair of opposed rotary end supports mounted for rotation on a support shaft with one end support movable along the shaft relative to the other to clamp the roll therebetween for conjoint rotation relative to the shaft.

A first hand grip is arranged in coaxial alinement with the one rotary end member disposing the roll below the first hand grip in a depending manner, and a second hand grip is positioned at an adjacent location to one side of the reel assembly whereby the reel assembly is hand-held by the user in a balanced manner between the object and the user so that the user may readily move around the object on which the film is wrapped under the desired tension. The one rotary end support and first hand grip are on a body that is internally threaded and thread on one end of the support shaft so that, as the first hand grip is threaded toward the other rotary end support, that other rotary end support is moved against a friction surface to adjust the drag on the roll. The threading of the first hand grip away from the other rotary end support facilitates the removal of the first hand grip and the one rotary end support for the ready replacement of a roll of film.

Other objects, advantages and capabilites of the present invention will become more apparent as the description proceeds, taken in conjunction with the accompanying drawings in which like parts have similar reference numerals and in which.

Figure 1:
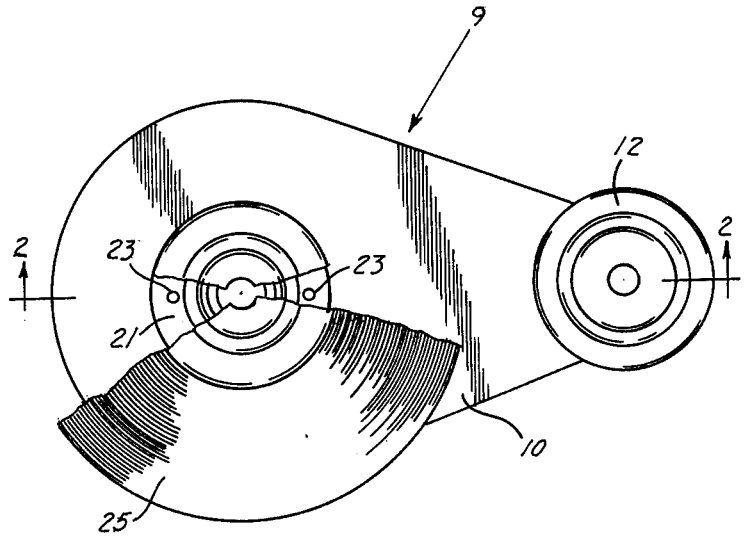
FIG. 1 is a top plan view of a plastic stretch film dispenser with only a portion of the roll of film shown in place for clarity.
Figure 2:
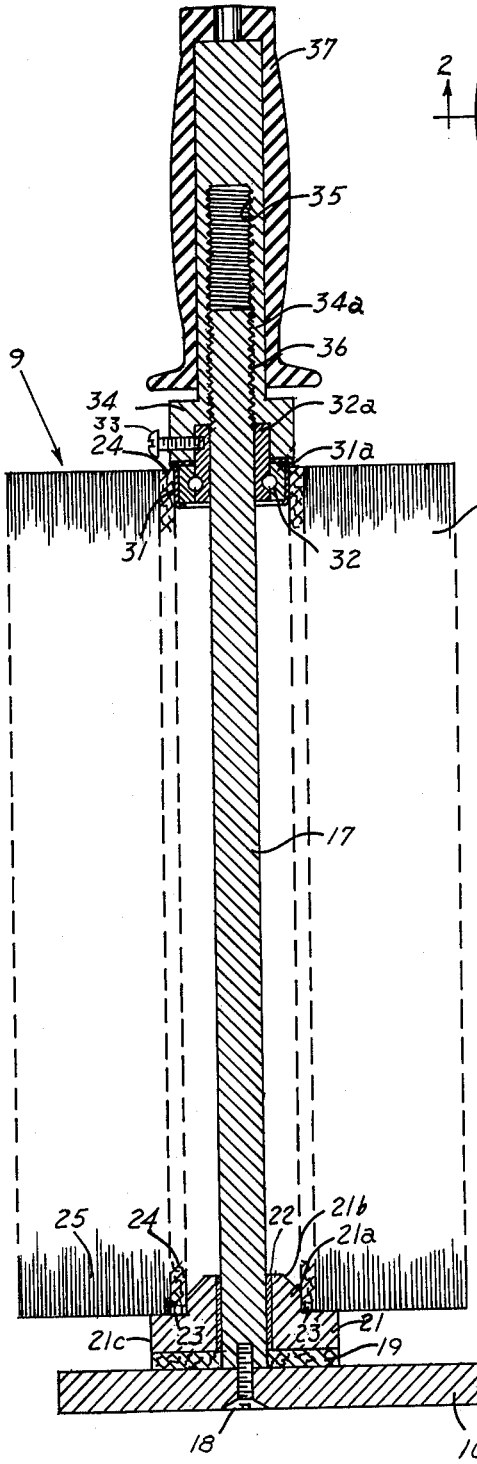
FIG. 2 is a sectional view taken along lines 2–2 of FIG. 1 with a portion of the roll of film shown in place.
Figure 2:
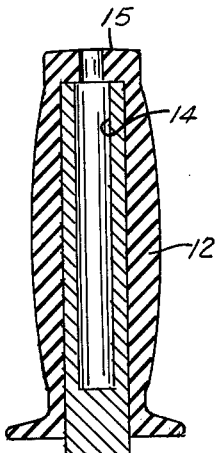

Referring now to the drawings, there is shown a film wrapping dispenser 9 having a tapered, rigid base plate 10 which, as shown in plan, has a wider end portion that becomes gradually thinner in width toward a narrower end portion with the ends thereof being rounded and semicircular in shape. A support shaft 11 is secured to the top of the base plate 10 adjacent the narrower end portion by a screw 13. Shaft 11 has a resilent handle or hand grip 12 at the upper end for gripping by the user to position and pull on the reel assembly to unwind the film, as described hereinafter. As an optional feature the shaft has an aperture 14 in the top end thereof, preferably for containing a cutting knife which is inserted through a hole 15 in the end of the resilient hand grip 12.

The support shaft 11 and handle or hand grip 12 are opposite, parallel to, and spaced from a support shaft 17 that is fixedly secured to the top surface of the base plate adjacent the wider end portion by a screw 18. A pair of opposed rotary end supports 21 and 32 are mounted for rotation on the shaft 17 and each is externally sized and shaped to insert into the ends of a roll core 24 on which a roll of plastic stretch film 25 is wound.

Rotary end support 21 is of a generally cylindrical shape with a stepped or notched portion with a smaller diameter cylindrical portion **21*a* sized to insert into one end of the roll core and has a beveled edge 21*b* with a larger diameter cylindrical portion 21*c* that seats on a disc-shaped friction member 19 in the form of a fabric, felt, or leather disc-shaped body. Friction member 19 in turn rests on plate 10. The rotary end support 21 is supported for free rotation at one end of shaft 17 on a sleeve bearing 22. A releasable fastening or gripping arrangement is provided to fasten the rotary end support 21 to the roll core 24 in the form of two diametrically opposed pins 23 that projects from the support 21 and into roll core 24 to provide for the conjoint rotation of support 21 with roll core 24**.

The other rotary end support 31 is constructed as a part of the outer race of a ball bearing designated by numeral 32 which in turn is carried on a support body 34. More specifically, the support body 34 has an internal bore into which an inner race portion 32*a* of the bearing 32 is inserted in a friction engagement and is further secured to body 34 by a screw 33. The inner race portion 32*a* is substantially longer than the outer race forming end support 31 so as to project into the internal bore in body 34. End support 31 has a cylindrical external shape to releasably insert into the roll core 24 of the roll of film. Rotary end support 31 is provided with an outer lip 31*a* limiting the extent of its insertion into the core 24.

The support body 34 as well as a handle extension 34*a* integral therewith are provided with an internally threaded bore 35 which threads on external threads 36 on the free end of the shaft 17. A resilient hand grip 37 is mounted on the handle extension 34*a* for gripping by the user, positioning one hand grip in coaxial alinement with both rotary end supports. When support body 34 threads on shaft 17 the rotary end support 31 is moved toward or away from end support 21 in selected increments.

With this movable arrangement of one of the rotary end supports on shaft 17, when the support body 34 is threaded to move toward rotary end support 21 the core 24 is clamped between the rotary end supports 21 and 31 while at the same time rotary end support 21 is urged against the friction member 19 to increase the drag on the roll 25. Since the user is gripping grip 37 in pulling the film from the roll during wrapping, a rotation of the hand grip is used to preset, increase, decrease or quick-release the tension on the roll.

When the support body 34 and associated extension 34*a* and grip 37 are rotated a sufficient number of revolutions in a dirction to move rotary end support 31 in a direction away from rotary end support 21, they become detached from shaft 17 and this facilitates the removal of the roll of film and replacement with a new roll of film. It is further noted that end support 31 rotates on the bearing 32 relative to shaft 17, which is effective in manipulation of the roll during the wrapping of the film under tension, as described hereinafter.

The tension is adjusted by rotating hand grip 37 in one direction or the other, which moves rotary end support 31 relative to rotary end support 21 as required. Rotation of hand grip 37 presets the tension. When greater tension is required, the hand grip 37 is threaded so that the rotary end support 31 is positioned closer to rotary end support 21, and rotary end support 21 is urged against friction member 19. During the wrapping operation supports 31 and 21 clamp against core 24 and they rotate conjointly on their associated bearings relative to shaft 17.

Figure 3:
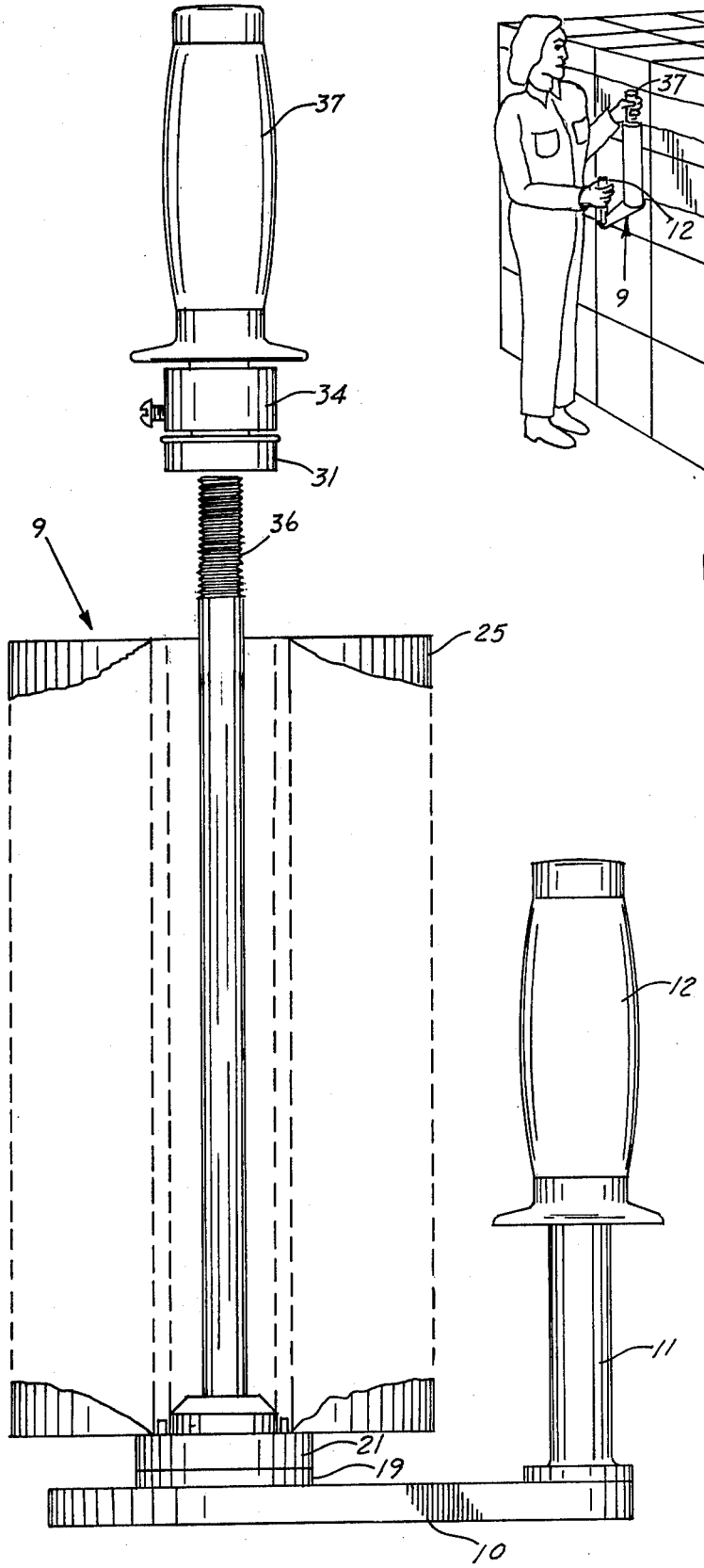
FIG. 3 is a side elevational view of the dispenser shown in FIGS. 1 and 2 with the handle grip and one rotary end support raised to an elevated position.

In order to replace a roll of film, the support body 34 and associated grip 37 are rotated in a direction to unthread and they are removed from shaft 17, as shown in FIG. 3.

Figure 5:
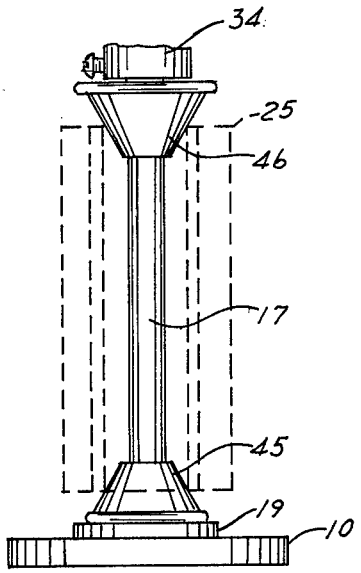
FIG. 5 is an end elevational view illustrating an alternative form of rotary end supports for the roll of film.

A modified form of rotary end support is shown in FIG. 5 wherein the upper rotary end support 46 and the lower end support 45 have inwardly tapered roll-engaging surfaces to grip the ends of the roll as an alternative means for the gripping of the roll by the rotary end supports as the rotary end support 46 is threaded down toward the rotary end support 45.

Figure 4:
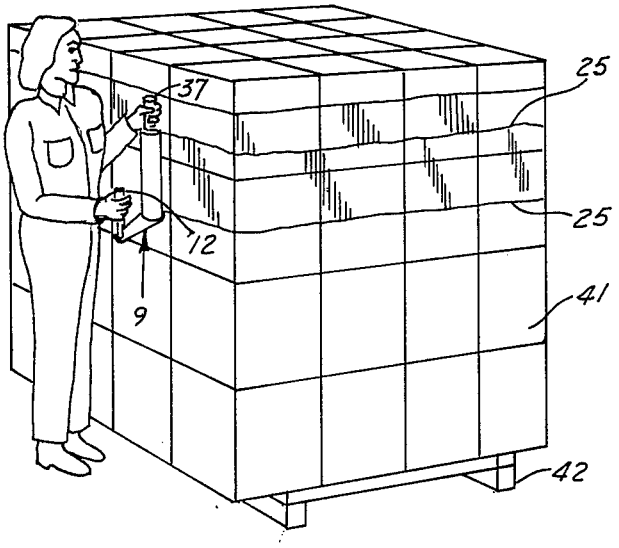
FIG. 4 is a perspective view of the film being applied by the dispenser to a plurality of containers on a pallet.

Reference is now made to FIG. 4 for explaining the use and operation of the above-described dispensers. The dispenser is grasped by the user with one hand on each of the hand grips 12 and 37 to dispose the roll of film 25 below the hand grip 37 in a depending manner. The grip 12 preferably is normally disposed back of the roll with the roll between the object and the user and in this way the user may readily move around the object on which the film is wrapped, pulling away from the object, as shown.

The object shown in FIG. 4 is a pallet 42 on which there is supported a plurality of cartons 41. The free end of the film is affixed to one container and the user presets and adjusts the tension during the wrapping operation by turning hand grip 37 and pulling on the film while walking around the object. At the corners the tension is usually increased for a tighter wrap. Successive layers of the film 25 overlap one another. When upright surfaces are wrapped, the roll is disposed for rotation about a vertical axis and one hand is above the roll in coaxial alinement therewith and the other is to the back of the roll. This structural arrangement and positioning of the hands relative to the roll affords a balanced structure and the tension is applied substantially uniformly across the strip of film.

Although the present invention has been described with a certain degree of particularity, it is understood that the present disclosure has been made by way of example and that changes in details of structure may be made without departing from the spirit thereof.

What is claimed is:

1. A film dispenser comprising:

reel means including a pair of opposed, rotary end supports mounted on a support shaft for supporting a roll of film for rotation relative to said shaft, one of said rotary end supports being movable along said shaft toward and away from the other of said rotary end supports to clamp the roll of film between said rotary end supports for conjoint rotation of said rotary end supports and said roll relative to said shaft, said reel means having a hand grip means attached to said support shaft by which said reel means is hand-held for pulling on the film while an end portion of the film is held on an object during the wrapping of the film about the object to unwind the film under tension, said hand grip means including a first hand grip operatively associated with said one rotary end support to move said one rotary end support along said support shaft to clamp the roll between said pair of rotary end supports and to urge the other of said rotary end supports against a friction surface opposite said one rotary end support to set the tension and to change tension on the film during said wrapping by the movement of said first hand grip.

2. A film dispenser as set forth in claim 1 wherein said friction surface is on a base attached to one end of said support shaft.

3. A film dispenser as set forth in claim 2 wherein said shaft has an externally threaded end portion and said one rotary end support is carried on an internally threaded body to move in increments relative to said other rotary end support.

4. A film dispenser as set forth in claim 3 wherein said first hand grip is an extension of an integral part of said internally threaded body associated with said one rotary end support.

5. A film dispenser as set forth in claim 2 wherein said friction surface is provided by a generally disc-shaped friction member disposed on a rigid base plate, said disc-shaped friction member having an aperture for slide-fitting on said support shaft between said other rotary end support and said base plate.

6. A film dispenser as set forth in claim 5 wherein said disc-shaped friction member is made of leather.

7. A film dispenser as set forth in claim 5 wherein said disc-shaped friction member is made of felt.

8. A film dispenser as set forth in claim 1 wherein said other rotary end support has projecting pin-like means for releasably gripping one end of said roll for the conjoint rotation of said roll with said other rotary end support.

9. A film dispenser as set forth in claim 1 wherein each of said rotary end supports is mounted on a bearing member to rotate freely relative to said support shaft.

10. A film dispenser as set forth in claim 9 wherein said bearing member for said one rotary end support is a ball bearing.

11. A film dispenser as set forth in claim 9 wherein said bearing member for said other rotary end support is a sleeve bearing.

12. A film dispenser as set forth in claim 1 wherein said hand grip means includes a second hand grip connected to the end of said support shaft opposite the end of said shaft connected to said first hand grip.

13. A film dispenser as set forth in claim 12 including a second support shaft parallel to said support shaft for said roll with said second hand grip mounted on said second shaft and disposed approximately midway between said opposed rotary end supports.

14. A film dispenser as set forth in claim 13 wherein said support shaft and said second support shaft are secured at one end to a common base plate, said base plate supporting a friction member which in turn supports said other rotary end support member whereby the movement of said first hand grip urges said other rotary end support against said friction member to increase the drag on said roll of film.

15. A film dispenser as set forth in claim 1 wherein said base plate is tapered, being wider at one end portion to which said first support shaft is connected and narrower at the other end portion to which said second support shaft is connected.

16. A film dispenser as set forth in claim 13 wherein said second hand grip is hollow to provide a storage cavity for a blade for cutting said film.

17. A film dispenser as set forth in claim 1 wherein said rotary end supports are externally cylindrical and sized to insert into openings in the ends of said roll of film.

18. A film dispenser as set forth in claim 1 wherein said rotary end supports are externally tapered to insert into open ends of the roll of film to releasably secure said rotary end supports to the roll for conjoint rotation therewith.

19. A film dispenser as set forth in claim 1 wherein said one rotary end support is removable from said support shaft to facilitate the replacement of said roll of film.

20. A film dispenser comprising:

reel means including a pair of opposed, rotary end supports mounted on a support shaft for supporting a roll of film for rotation relative to said shaft, one of said rotary end supports being movable along said shaft toward and away from the other of said rotary end supports to clamp the roll of film between said rotary end supports for conjoint rotation of said rotary end supports and said roll relative to said shaft, said reel means having a hand grip means attached to said support shaft by which said reel means is a hand-held for pulling on the film while an end portion of the film is held on an object during the wrapping of the film about the object to unwind the film under tension, said hand grip means including a first hand grip operatively associated with said one rotary end support to move said other rotary end support against a friction surface held against axial movement relative to said shaft and opposite said one rotary end support to set the tension and to change tension on the film during said wrapping by the movement of said first hand grip.

21. A hand-held plastic stretch film dispenser for wrapping a roll of plastic stretch film subject to tension about an object comprising:

a reel assembly for supporting a roll of plastic film for rotation including a base plate having a first support shaft mounted upright on said base plate, a pair of opposed, rotary end supports rotatably mounted on said shaft arranged for releasably engaging the opposite ends of a roll of plastic stretch film, one of said rotary end supports being threaded on said shaft to move in increments toward and away from the other of said rotary end supports to clamp the roll of film for conjoint rotation of said rotary end supports and said roll relative to said support shaft, a friction member on said base plate disposed between the other of said rotary end supports and said base plate, said one rotary end support being selectively positioned along said support shaft relative to the other rotary end support to clamp said roll and to urge said other rotary end support against said friction member to apply a selected amount of drag on said roll thereby selectively controlling the tension on the film as the film is unwound from said reel assembly; and a first and a second hand grip by which said reel assembly is held by two hands in front of the user in a balanced manner for pulling on the film while an end portion of the film is held on an object during the wrapping of the film about the object to unwind the film under tension, said first hand grip being an extension of and an integral part of said one rotary support member in coaxial alinement with said rotary end supports so that, as said one rotary support member and first grip are threaded on said shaft, said other rotary end support is moved against said friction member to change the tension on the film via movement of the grip portion during the wrapping of the film about an object, whereby the user may progressively move around an object and wrap film thereon with a selectively controlled amount of tension on the film, said second hand grip being mounted on a second support shaft on said base plate in spaced parallel relation to said first support shaft, said second hand grip being spaced to one side of said rotary end supports and centered approximately midway between said rotary end supports.

* * * * *

UNITED STATES PATENT AND TRADEMARK OFFICE

CERTIFICATE OF CORRECTION

PATENT NO. : 4,102,513

DATED : July 25, 1978

INVENTOR(S) : Twyman Guard

It is certified that error appears in the above-identified patent and that said Letters Patent are hereby corrected as shown below:

In the heading on the first page of the patent, below

"Inventor: Twyman Guard, 795 S. Alton Way,
Denver, Colo. 80231"

insert:

--Assignee: Guard Associates, Inc., Englewood, Colo.--

Col. 3, line 3, change "projects" to --project--

Line 42, correct the spelling of "direction"

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*